US008021064B2

(12) United States Patent
Gueret

(10) Patent No.: US 8,021,064 B2
(45) Date of Patent: Sep. 20, 2011

(54) PACKAGING AND APPLICATOR DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1115 days.

(21) Appl. No.: 11/797,472

(22) Filed: May 3, 2007

(65) Prior Publication Data

US 2007/0258749 A1 Nov. 8, 2007

Related U.S. Application Data

(60) Provisional application No. 60/815,602, filed on Jun. 22, 2006.

(30) Foreign Application Priority Data

May 5, 2006 (FR) ..... 06 51643

(51) Int. Cl.
*A46B 11/00* (2006.01)

(52) U.S. Cl. ..... 401/47; 401/44

(58) Field of Classification Search ..... 401/16, 401/44–47; 222/129, 132, 135
See application file for complete search history.

(56) References Cited

U.S. PATENT DOCUMENTS

| | | | | | |
|---|---|---|---|---|---|
| 1,062,053 | A | * | 5/1913 | Strong | 401/45 |
| 1,573,758 | A | * | 2/1926 | Attarian et al. | 401/45 |
| 2,661,870 | A | * | 12/1953 | Huenergardt | 222/129 |
| 2,779,961 | A | * | 2/1957 | Laughlin | 401/46 |
| 3,405,997 | A | * | 10/1968 | Diebold | 401/46 |
| 5,088,849 | A | | 2/1992 | Johnson et al. | |
| 5,090,832 | A | * | 2/1992 | Rivera et al. | 401/132 |
| 5,111,972 | A | | 5/1992 | Sakurai et al. | |
| 5,833,121 | A | | 11/1998 | Gueret | |
| 6,454,135 | B1 | * | 9/2002 | Brozell | 222/135 |

FOREIGN PATENT DOCUMENTS

| | | |
|---|---|---|
| CH | 539 551 | 9/1973 |
| DE | 244227 | 5/1925 |
| EP | 0 427 609 A1 | 5/1991 |
| EP | 0 758 615 A1 | 2/1997 |
| EP | 1 541 496 A1 | 6/2005 |
| FR | 2 664 571 A1 | 1/1992 |
| FR | 2 850 545 A1 | 8/2004 |
| WO | WO 2005/039350 A1 | 5/2005 |

* cited by examiner

*Primary Examiner* — David J Walczak
(74) *Attorney, Agent, or Firm* — Oliff & Berridge, PLC

(57) ABSTRACT

A packaging and dispenser device includes at least two reservoirs containing two different compositions for application to the human body, and a fluid-application surface that is flocked at least in part, and onto which there open out at least two distinct dispenser orifices that are fed by the first and second reservoirs respectively.

37 Claims, 4 Drawing Sheets

PACKAGING AND APPLICATOR DEVICE

This non provisional application claims the benefit of French Application No. 06 51643 filed on May 5, 2006 and U.S. Provisional Application No. 60/815,602 filed on Jun. 22, 2006.

The present invention relates to packaging and applicator devices for cosmetic or dermatological treatment of keratinous materials such as the skin, the lips, or the hair.

BACKGROUND

Devices have already been proposed, in particular in patent EP 0 758 615 B1, that comprise at least two reservoirs and a dispenser system, making it possible to dispense selectively the compositions contained in the reservoirs.

Patent CH 539 551 discloses a device that seeks to dispense two compositions in relative proportions that are selected by the user. The compositions flow to the end of a rotary endpiece via two dispenser orifices that are close together. Application DE 2 444 227 describes a similar device.

Application EP 0 427 609 A1 describes a device including a dispenser head that is provided with an endpiece at the end of which there open out two dispenser orifices that are close together, the displacement of the head relative to the reservoirs making it possible to actuate pumps.

Those known devices make it possible to dispense the compositions into the hand where they may then be mixed together, if they have not already been mixed together within the device, with a view to spreading the mixture onto the body with the hand, for example. They are not completely satisfactory for dispensing colored compositions such as makeup compositions, since the user may not wish to bring the hand directly into contact therewith.

In a variant, the user may use a sponge onto which the compositions are deposited before application. However, such a sponge is not always available, and its use may result in a loss of composition that is not negligible.

SUMMARY

The invention seeks to improve still further packaging and dispenser devices including at least two reservoirs containing two different compositions for application to the human body.

In particular, the invention seeks to propose a device that is relatively simple to construct, practical to use, and that is suitable, in particular, for applying makeup compositions.

In one of its aspects, the invention provides a packaging and dispenser device, comprising:

- at least two reservoirs containing two different compositions for application to the human body; and
- a fluid-application surface onto which there open out at least two distinct dispenser orifices that are fed by the first and second reservoirs respectively.

The application surface may be flocked at least in part, which may improve comfort in use and also application of the composition, and may improve the retention, by capillarity, of the compositions on the application surface, which may make it easier to spread the compositions and increase the length of time that the application surface can be used.

A flocked surface enables application to be performed with surface capillarity, and enables the two compositions to be mixed together on the skin, with said compositions being presented in different phases, for example.

The application surface may be defined by a non-porous wall, including through orifices for dispensing the composition concerned. The non-porous wall may be flocked, as indicated above.

Regardless of whether or not the application surface is flocked, the first and second orifices may be spaced apart by a distance of at least 1 centimeter (cm) on the application surface. This makes it possible to form, between the first and second orifices, a surface that is used for mixing the compositions on the application surface.

In another aspect of the invention, regardless of any flocking of the application surface, and of the distance between the first and second orifices, at least one of the first and second compositions is dispensed onto the application surface via a plurality of orifices. This makes it possible to improve the distribution of at least one of the compositions on the application surface, and potentially makes it easier to mix it with the other composition.

The device may include a first set of dispenser orifices that are fed by the first reservoir. The device may include a second set of dispenser orifices that are fed by the second reservoir. The first set of orifices may be situated in a first half of the application surface, and the second set of orifices may be situated in a second half of the application surface. The orifices of the second set may be situated around the orifices of the first set. The orifices of the first set may also be disposed in at least two groups of orifices that are respectively situated on either side of the orifices of the second set.

The application surface may be defined, at least in part, by a flexible wall. This makes it easier for the application surface to match the outline of the region being treated, and, where appropriate, makes it possible to increase the pressure inside the device, so as to encourage at least one of the compositions to flow towards the application surface.

The device may include a duct that is in communication with at least one dispenser orifice and with the corresponding reservoir. The duct may be movable relative to the reservoir, so that it does not hinder unduly the pressing down of the wall that defines the application surface at least in part. The duct may be formed, at least in part, by being molded with the wall, for example.

The device may include a support onto which the above-mentioned wall is fitted.

Each reservoir may include a respective neck that is engaged in the support, which support may contribute, at least in part, to holding the reservoirs secure relative to each other.

The first and second reservoirs may be disposed coaxially or otherwise, e.g. as a function of the disposition desired for the dispenser orifices.

The first and second reservoirs may be formed, at least in part, within a receptacle body that is made as a single part by molding.

The device may include an extractor system that is associated with at least one of the reservoirs, in particular an extractor system including a pump that may optionally by an airless pump.

The application surface may be secured to a head that is movable relative to the reservoirs by turning or otherwise. The head may be arranged so as to act on the above-mentioned extractor system.

The device may also be configured in such a manner as to enable the user, e.g. by displacing the above-mentioned head, to act on the quantity of composition dispensed onto the application surface from one or other of the reservoirs.

The device may include a plurality of orifices that are capable of being put into communication selectively with one of the reservoirs, in response to an action exerted by the user on the device, e.g. turning the above-mentioned head.

At least one of the reservoirs may include a flexible wall, thereby enabling the user to dispense the contents thereof by squeezing it.

The first and second orifices may be in permanent fluid communication with the first and second reservoirs respectively.

The device may include at least one closure/opening system that makes it possible to establish or to interrupt communication between at least one of the reservoirs and the dispenser orifice(s) that are associated with said reservoir. The closure/opening system may be arranged to establish or to cut off communication with only one of the reservoirs or with all of the reservoirs and/or may enable the user to choose which reservoir(s) to open or to close.

The device may include at least one piston and a drive mechanism for said piston, so as to force the composition contained in at least one of the reservoirs to flow through the associated dispenser orifice(s).

The two reservoirs may be formed by at least two spaces inside a single chamber, the compositions contained in the spaces possibly being dispensed simultaneously under the pressure of at least one piston, for example.

By way of example, a second composition may be disposed above a first composition, and the pressure necessary to dispense the second composition may be transmitted to the second composition via the first composition. The reservoir containing the second composition may surround a duct, enabling the first composition to reach at least one associated dispenser orifice. At least one dispenser orifice may open out into the reservoir containing the second composition.

The device may include an adjustment member for adjusting the flow towards the first and/or the second orifice.

The first and second orifices may open out onto a generally plane or convex region of the application surface. At least one of the orifices may be oriented substantially parallel to a longitudinal axis of the device.

The first and second compositions may be for application to the skin or to the lips.

The first composition may include a coloring agent, and the second composition need not include a coloring agent.

The first and second compositions may be intended to be applied separately, in succession, e.g. a base coat and a top coat, or simultaneously by being mixed.

The first and second compositions may include compounds that are incompatible and that require separate storage. By way of example, the compounds are for mixing extemporaneously.

The first and second compositions may be creams or gels.

In another of its aspects, the invention also provides a cosmetic treatment using a device as defined above, in which treatment at least one of the first and second compositions is dispensed onto the application surface, and then the application surface is brought into contact with the region to be treated.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
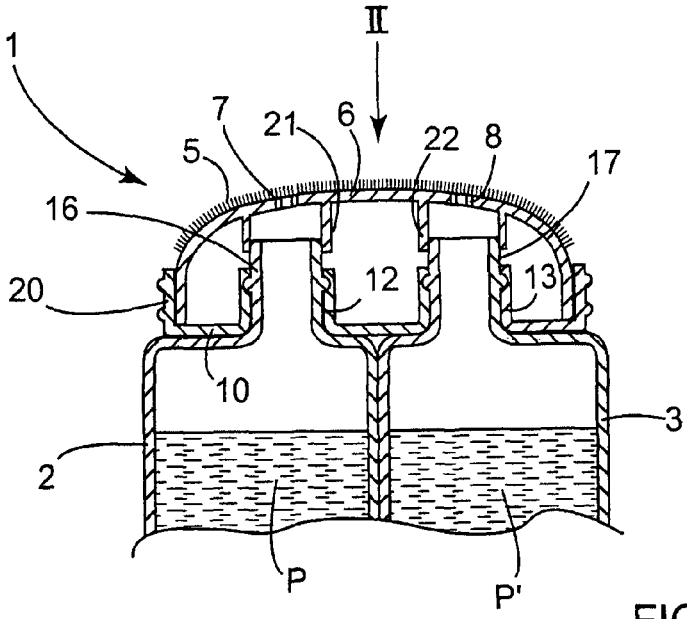
FIG. 1 is a fragmentary longitudinal section of an example of a device constituting an embodiment of the invention.

The device 1 shown in FIG. 1 comprises: two reservoirs 2 and 3 containing respective compositions P and P'; and an application surface 5, which, in the example under consideration, is defined by a flocked wall 6, through which there pass dispenser orifices 7 and 8 that communicate with the reservoirs 2 and 3 respectively.

The wall 6 is fitted onto a support 10 that includes two openings 12 and 13 in which necks 16 and 17 of the reservoirs 2 and 3 are respectively engaged.

The support 10 contributes to holding the reservoirs 2 and 3 stationary relative to each other, and can further include an externally-threaded skirt 20, so as to make it possible to receive a closure cap (not shown).

The wall 6 can be made integrally with ducts 21 and 22 that become engaged on the necks 16 and 17 respectively, in such a manner as to provide substantially leaktight communication between the reservoirs 2 and 3 and the dispenser orifices 7 and 8.

The wall 6 can be molded in a flexible material, so as to constitute a flexible membrane, making it possible to increase comfort in application. In particular, the wall 6 can be made in such a manner as to enable the application surface 5 to be displaced to a certain extent during use, the ducts 21 and 22 advantageously being made in such a manner as to be able to slide over the necks 16 and 17 while the wall 6 is being pressed down relative to the reservoirs 2 and 3.

The wall 6 can be fastened by snap-fastening inside the support 10, as can the necks 16 and 17, but fastening by other means is possible, e.g. by adhesive, heat sealing, riveting, screw-fastening, crimping, or by means of at least one add-on fastener element.

Figure 2:
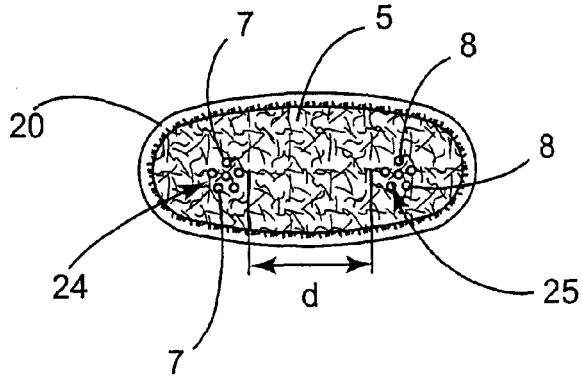
FIG. 2 is a plan view of the FIG. 1 device.

The device 1 can include a plurality of dispenser orifices 7 that are associated with the reservoir 2, and a plurality of dispenser orifices 8 that are associated with the reservoir 3, as shown in FIG. 2.

The set 24 of orifices 7 can be situated in a first half of the application surface 5, and the set 25 of orifices 8 can be situated in the second half of the application surface. This can enable the compositions P and P' to be applied separately, if necessary.

In order to use the device 1, the user delivers at least one of the compositions P and P' onto the application surface 5 via the orifices 7 and 8 respectively.

The quantities of the compositions P and P' that have been dispensed on the application surface 5 through the orifices 7 and 8 need not mix together initially, and they may remain in the vicinity of the orifices 7 and 8 respectively. If so desired, during application, the user can mix the compositions P and P' on the application surface 5 and on the region being treated by moving the device 1 appropriately.

Various means can be used to deliver the compositions P and P' onto the application surface 5.

By way of example, the reservoirs 2 and 3 can be flexible-walled reservoirs, such that the user can cause their contents to be dispensed by squeezing their walls.

Figure 3:
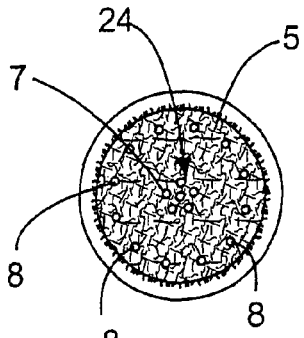
FIGS. 3 and 4 are views similar to FIG. 2 showing variant embodiments.

The dispenser orifices communicating respectively with the two reservoirs can be arranged in various ways, e.g. it is possible to have a first set of dispenser orifices that are situated substantially at the center of the application surface 5, whereas the dispenser orifices that are associated with the other reservoir are disposed coaxially about the first set 24, as shown in FIG. 3.

Figure 4:
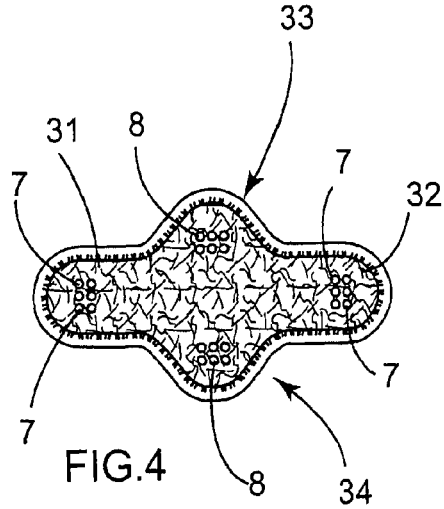

As shown in FIG. 4, it is also possible to have the first set of dispenser orifices made up of two groups 31 and 32, whereas the orifices that are associated with the other reservoir are situated between the first and second groups 31 and 32, e.g. in two other groups 33 and 34.

The distance d between the orifices 7 and 8 can be sufficient to avoid the compositions P and P' mixing spontaneously while normal quantities of said compositions are being dispensed, thereby enabling the user to mix them if necessary and as so desired, for example without necessarily using in full the quantities of the compositions P and P' that are present on the application surface.

Numerous modifications can be brought to the arrangement of the reservoirs 2 and 3, in particular as a function of the disposition of the dispenser orifices on the application surface 5.

Figure 5:
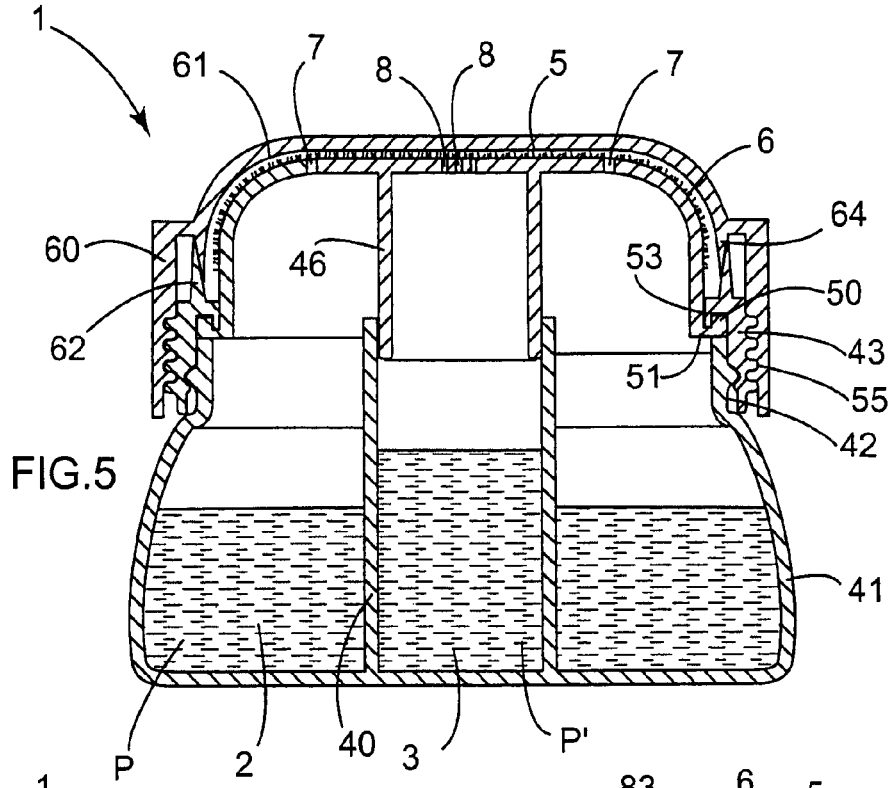
FIGS. 5 to 8 are diagrammatic longitudinal sections of other variants of the device.

For a device having a coaxial arrangement of orifices as shown in FIG. 3, the reservoirs 2 and 3 can also be coaxial for example, as shown in FIG. 5, the reservoir 3 being separated from the reservoir 2 by a cylindrical wall 40.

The reservoirs 2 and 3 can be formed as a single part by molding the cylindrical wall 40 together with a body 41 of a receptacle that is provided with a neck 42 onto which there can be fastened a support 43 that is used to fasten the wall 6 onto the neck 42.

The wall 6 can be made with a duct 46, making it possible to provide substantially leaktight communication between the orifices 8 and the reservoir 3, the duct 46 being engaged in the central wall 40.

Where appropriate, the wall 6 can be made with a turned-up edge 50 forming an annular groove 51 in which a rim 53 of the support 43 can be engaged, thereby making it possible to provide a certain amount of clamping of the wall 6 between the support 43 and the top edge of the neck 42, and making it possible to obtain good leaktight assembly of the wall 6 on the body 41.

The support 43 can be fastened on the neck 42 by snap-fastening, for example, and can include a thread 55 making it possible to receive a closure cap 60. The closure cap can present an inside face 61 that substantially matches the shape of the application surface 5, in such a manner as to minimize the volume of air that is held captive between the wall 6 and the cap 60 when said cap is in place.

The support 43 can be made with a sealing lip 62 that co-operates with a corresponding sealing lip 64 of the cap 60.

Where appropriate, the wall 6 is flexible, being made of an elastomer material, for example, and the duct 46 is mounted on the cylindrical wall 40, for example, in such a manner as to be capable of being axially displaced relative to said cylindrical wall, so as to accompany the deformation of the application surface 5, while substantially maintaining leaktight communication between the inside of the reservoir 3 and the orifices 8.

Figure 6:
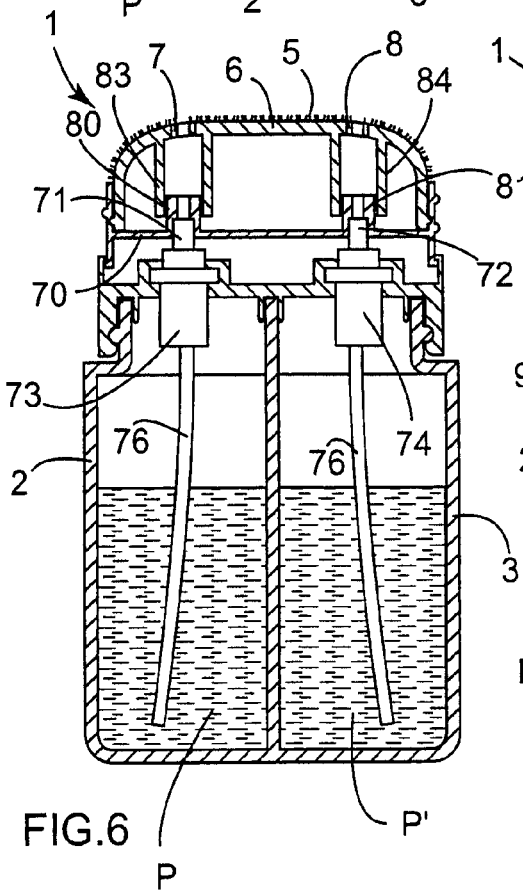
Figure 7:
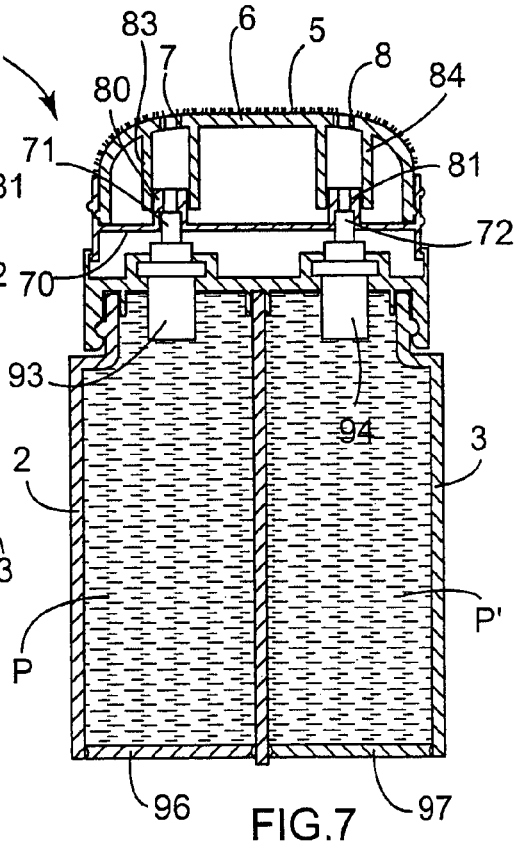

FIGS. 6 and 7 show variant embodiments in which the wall 6 that defines the application surface 5 is movable relative to the reservoirs 2 and 3, being carried by a support 70 that is axially movable relative to the reservoirs 2 and 3, for example. In the example in FIG. 6, the support 70 is arranged to co-operate with rods 71 and 72 of pumps 73 and 74 that communicate with the insides of the reservoirs 2 and 3 by means of a dip tube 76.

The rods 71 and 72 are engaged in endpieces 80 and 81 with which there can co-operate ducts 83 and 84 that communicate with the orifices 7 and 8 respectively.

In order to use the device 1 in FIG. 6, the user presses down the support 70, thereby displacing the rods 71 and 72 and actuating the pumps 73 and 74. Pressing down the support 70 can result in pressure being exerted by the application surface 5 against the region being treated.

In the example in FIG. 6, the pumps 73 and 74 have respective air inlets, for example.

In a variant, the receptacles 2 and 3 could be pressurized receptacles, and the pumps 73 and 74 could be replaced by valves that could optionally be fitted with respective dip tubes.

In the variant shown in FIG. 7, the pumps 73 and 74 are replaced by airless pumps 93 and 94, the reservoirs 2 and 3 being provided with movable bottom walls 96 and 97 that are capable of being displaced towards the pumps 93 and 94 as the compositions P and P' are dispensed, for example.

Figure 8:
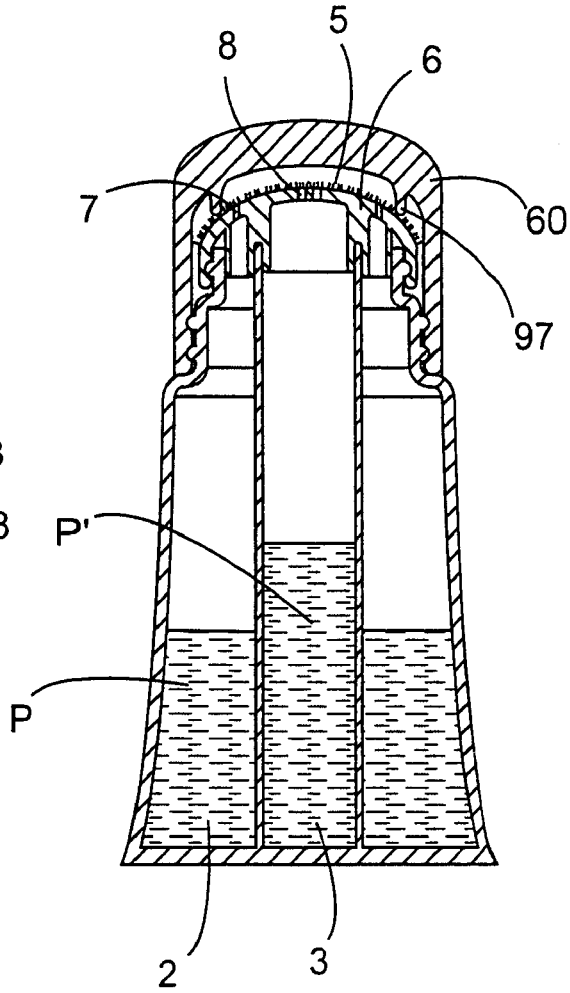

FIG. 8 shows a device that differs from the FIG. 5 device by the fact that the reservoirs 2 and 3 are formed within a flexible tube, thereby enabling the user to dispense the compositions P and P' by squeezing together opposite faces of the tube.

On examining FIG. 8, it should also be observed that the closure cap 60 can be provided with a portion in relief 97 that is arranged to bear against the application face 5 when the closure cap 60 is in place, in such a manner as to isolate, from the outside and in leaktight manner, the region of the application surface 5 onto which the orifices 7 and 8 open out. By way of example, the portion in relief 97 is in the form of an annular rib, and, in a variant not shown, could extend between the orifices 7 and 8, in such a manner as to cut off any communication between them.

Figure 9:
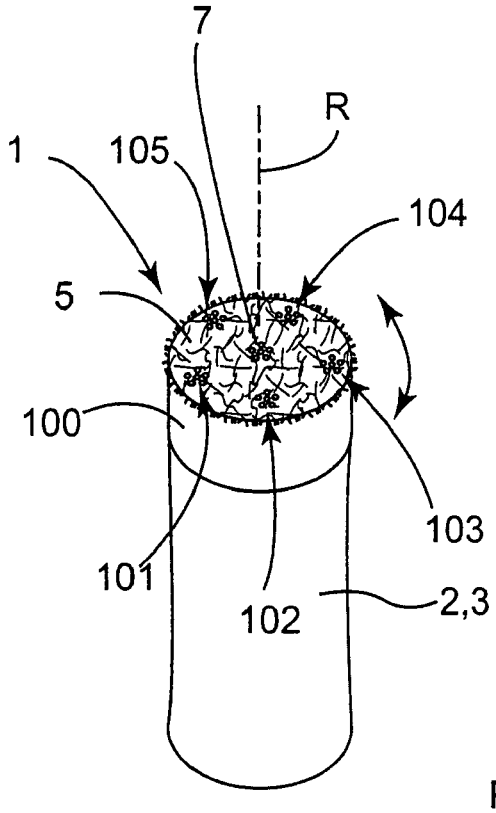
FIG. 9 is a diagrammatic perspective view of still another variant.

FIG. 9 shows a variant in which the device 1 includes a dispenser head 100 that is movable relative to the reservoirs 2 and 3, e.g. in turning about an axis R that coincides with the longitudinal axis of the device, for example.

The dispenser head 100 can include an opening/closure system making it possible to cut off or to establish communication with the various reservoirs.

A first set of orifices 7 can communicate with the reservoir 2, and a plurality of groups of orifices 101, 102, 103, 104, and 105 can be put into communication selectively with the reservoir 3, thereby enabling the user to vary the flow of compositions P and P' coming from the reservoirs 2 and 3 during use.

Figure 10:
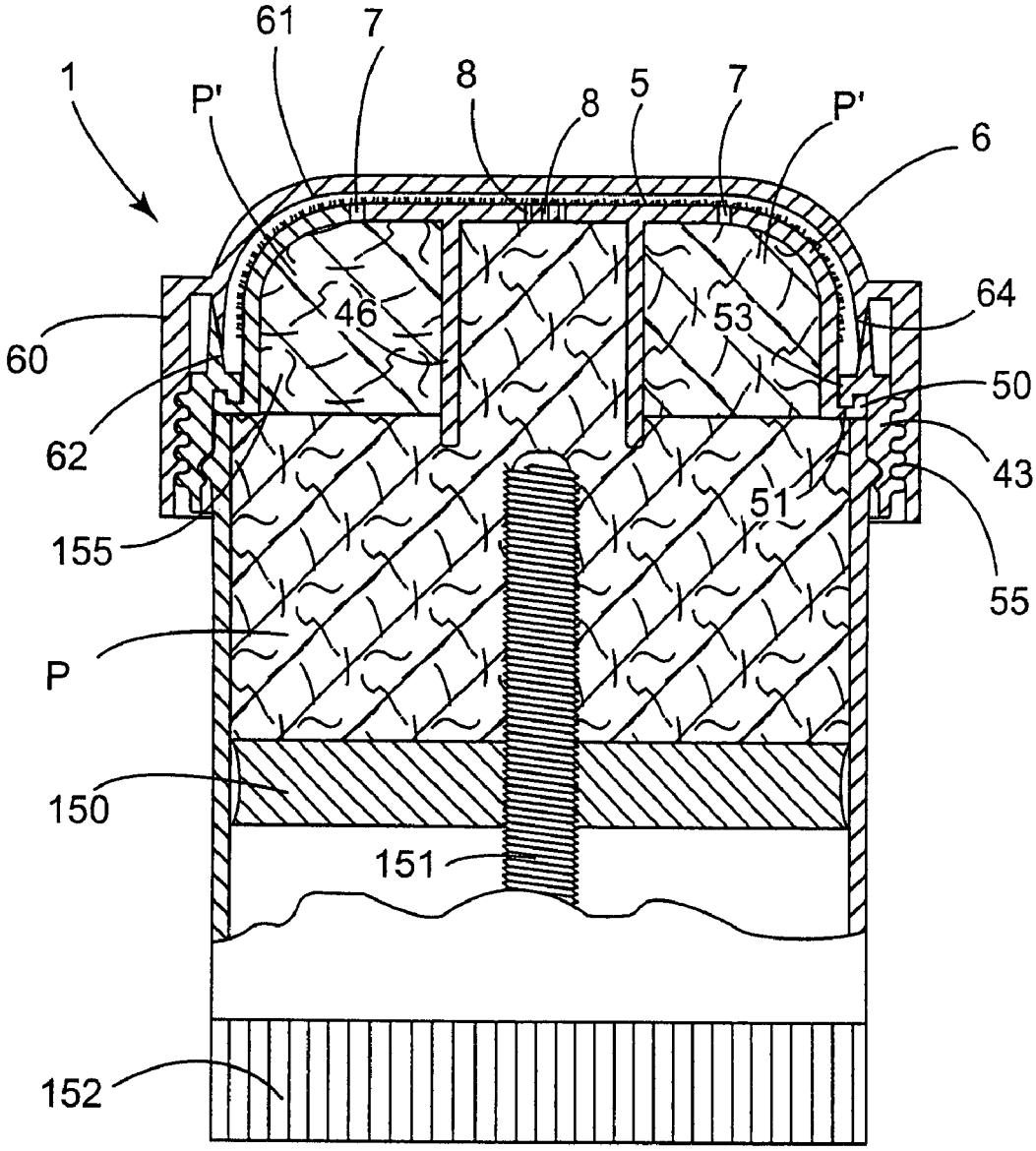
FIG. 10 is a fragmentary and diagrammatic longitudinal section showing a variant embodiment.

In the variant shown in FIG. 10, the two reservoirs are formed within a single chamber. The composition P' is contained in a space 155 above the composition P, and said composition P can be subjected to pressure from a piston 150 that is engaged on a screw 151 that is secured to a drive knob 152.

In the example shown, the space 155 extends around a duct 46 that is filled with composition P and that extends below the initial level of the composition P'. Thus, when the user turns the knob 152, the composition P is put under pressure by the piston 150 and is forced to flow through the orifices 8. The composition P' is also put under pressure by the composition P and flows through the orifices 7.

The device can be arranged in such a manner that the piston can only be displaced towards the orifices 7 and 8, even if the user attempts to turn the knob 152 in the direction opposite to the direction that causes the compositions to be dispensed.

Naturally, the invention is not limited to the examples described above.

For example, it is possible to make the dispenser head 100 in the FIG. 9 example in such a manner as to enable it to be displaced axially so as to act on at least one pump or valve, causing the compositions P and/or P' to be dispensed onto the application surface, for example.

The invention applies to dispensing more than two compositions, with a central reservoir containing one of the compositions, and a plurality of peripheral reservoirs containing other compositions for mixing with the composition contained in the central reservoir, for example.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The expression "comprising a" should be understood as being synonymous with "comprising at least one", unless specified to the contrary.

What is claimed is:

1. A packaging and dispenser device, comprising:

at least two reservoirs, each of the at least two reservoirs containing a different cosmetic and/or dermatological treatment composition, for application to keratinous materials, wherein at least one of the at least two reservoirs defines a gripping surface configured to be gripped during application of at least one of the cosmetic and/or dermatological treatment compositions; and a fluid-application surface defined at least partially by a wall molded from flexible material, the fluid application surface being flocked at least in part, and onto which opens at least two distinct dispenser orifices, a first of the at least two distinct orifices being fed by a first of the at least two reservoirs, and a second of the at least two distinct dispenser orifices being fed by a second of the at least two reservoirs.

2. The device according to claim 1, including a first set of dispenser orifices that are fed by the first reservoir.

3. The device according to claim 2, including a second set of dispenser orifices that are fed by the second reservoir.

4. The device according to claim 3, the first set of orifices being situated in a first half of the application surface, and the second set of orifices being situated in a second half of the application surface.

5. The device according to claim 3, the orifices of the second set being situated around the orifices of the first set.

6. The device according to claim 3, the orifices of the first set being disposed in at least two groups of orifices that are respectively situated on either side of the orifices of the second set.

7. The device according to claim 1, the application surface being defined, at least in part, by a flexible wall.

8. The device according to claim 1, including a duct that is in communication with at least one dispenser orifice and with a corresponding reservoir.

9. The device according to claim 8, the duct being movable relative to the reservoir.

10. The device according to claim 8, the duct being formed, at least in part, by being molded with a wall that defines the application surface at least in part.

11. The device according to claim 1, including a support onto which there is fitted a wall that defines the application surface at least in part, each reservoir including a respective neck that is engaged in the support.

12. The device according to claim 1, the first and second reservoirs being disposed coaxially.

13. The device according to claim 1, the first and second reservoirs being formed, at least in part, within a receptacle body that is made as a single part by molding.

14. The device according to claim 1, including an extractor system that is associated with at least one of the at least two reservoirs.

15. The device according to claim 14, the extractor system including a pump.

16. The device according to claim 15, the application surface being secured to a head that is movable relative to the at least two reservoirs, and the head being arranged so as to act on the extractor system.

17. The device according to claim 15, the pump having an air inlet.

18. The device according to claim 15, the pump being an airless pump.

19. The device according to claim 1, the application surface being secured to a head that is movable relative to the at least two reservoirs.

20. The device according to claim 19, the device being configured in such a manner as to enable the user, by displacing the head, to act on the quantity of composition dispensed onto the application surface from one or other of the at least two reservoirs.

21. The device according to claim 20, the head being movable by turning.

22. The device according to claim 1, including a plurality of orifices that are capable of being put into communication selectively with one of the at least two reservoirs, in response to an action exerted by the user on the device.

23. The device according to claim 1, at least one of the at least two reservoirs including a flexible wall.

24. The device according to claim 1, the first and second dispenser orifices being spaced apart by a distance of at least one centimeter on the application surface.

25. The device according to claim 1, the first and second orifices being in permanent fluid communication with the first and second reservoirs respectively.

26. The device according to claim 1, including an adjustment member for adjusting the flow towards the first and/or the second dispenser orifice.

27. The device according to claim 1, including at least one closure/opening system making it possible to establish or to interrupt communication between at least one of the reservoirs and the dispenser orifice(s) that are associated with said reservoir.

28. The device according to claim 1, including a piston and a drive mechanism for said piston, so as to force the composition contained in at least one of the reservoirs to flow through the associated dispenser orifice(s).

29. The device according to claim 1, the at least two reservoirs being formed by at least two spaces inside a single chamber.

30. The device according to claim 29, a second composition being disposed above a first composition, and the pressure necessary to dispense the second composition being transmitted to the second composition via the first composition.

31. The device according to claim 30, the second composition surrounding a duct, enabling the first composition to reach at least one associated dispenser orifice.

32. The device according to claim 1, the cosmetic and/or dermatological treatment compositions being configured for application to the skin or to the lips.

33. The device according to claim 1, a first of the cosmetic and/or dermatological treatment compositions including a coloring agent, and a second of the cosmetic and/or dermatological treatment compositions not including a coloring agent.

34. The device according to claim 1, the first and second dispenser orifices opening onto a generally plane or convex region of the application surface.

35. A cosmetic treatment using the device as defined in claim 1, in which treatment at least one of the cosmetic and/or dermatological treatment compositions is dispensed onto the application surface, and then the application surface is brought into contact with the region to be treated.

36. A packaging and dispenser device, comprising:

at least two reservoirs, each of the at least two reservoirs containing a different cosmetic and/or dermatological treatment composition, each of the compositions being for application to keratinous materials, wherein at least one of the at least two reservoirs defines a gripping surface configured to be gripped during application of at least one of the cosmetic and/or dermatological treatment compositions; and a fluid-application surface, defined at least partially by a wall molded from a flexible material and onto which opens at least two distinct dispenser orifices that are spaced apart by a distance of at least 1 cm, a first of the at least two distinct dispenser orifices being fed by a first of the at least two reservoirs, and a second of the at least two distinct dispenser orifices being fed by a second of the at least two reservoirs, the fluid-application surface being defined, at least in part, by a flexible wall.

37. A packaging and dispenser device, comprising:

at least two reservoirs, each of the at least two reservoirs containing a different cosmetic and/or dermatological treatment composition, and configured for application to the skin or to the lips, wherein at least one of the at least two reservoirs defines a gripping surface configured to be gripped during application of at least one of the cosmetic and/or dermatological treatment compositions; and a fluid-application surface, defined at least partially by a wall molded from a flexible material and onto which opens at least one dispenser orifice that is fed by a first of the at least two reservoirs, and a plurality of dispenser orifices that are fed by a second of the at least two reservoirs.

* * * * *